US006461012B1

(12) United States Patent
Shuman

(10) Patent No.: US 6,461,012 B1
(45) Date of Patent: Oct. 8, 2002

(54) PHOSPHORESCENT DOORKNOB LOCATOR RING

(75) Inventor: Willard E. Shuman, 3319 Las Palmas, Houston, TX (US) 77027

(73) Assignee: Willard E. Shuman, Houston, TX (US)

( * ) Notice: Subject to any disclaimer, the term of this patent is extended or adjusted under 35 U.S.C. 154(b) by 0 days.

(21) Appl. No.: 09/535,419

(22) Filed: Mar. 27, 2000

(51) Int. Cl.[7] ..... F05B 17/10
(52) U.S. Cl. ..... 362/100; 362/84
(58) Field of Search ..... 362/84, 100, 276, 362/253; 250/466.1, 462.1; 360/457

(56) References Cited

U.S. PATENT DOCUMENTS 2,085,331 A * 6/1937 Ramlau ..... 250/466.1
2,503,044 A * 4/1950 Guerra ..... 250/466.1
4,546,416 A * 10/1985 Pemberton ..... 362/84
4,914,554 A 4/1990 Sowers
4,981,314 A 1/1991 Carr
5,008,551 A 4/1991 Randolph
6,132,057 A * 10/2000 Williams ..... 362/100

* cited by examiner

*Primary Examiner*—Y. My Quach-Lee
(74) *Attorney, Agent, or Firm*—Kenneth A. Keeling; Keeling Hudson LLC

(57) ABSTRACT

A phosphorescent ring for providing a visual reference cue towards a doorknob or similar opening hardware. The ring may be attached around the doorknob with adhesive, or it may be hung on the doorknob. In the preferred embodiment, the ring is hung on the doorknob, allowing the ring to be used on a motel room door or other location where the room occupant is unfamiliar with the room layout and exit door location.

4 Claims, 3 Drawing Sheets

PHOSPHORESCENT DOORKNOB LOCATOR RING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention.

This invention relates to a product and method of locating doorknobs in low-light conditions. Specifically, the invention describes a phosphorescent plastic ring that attaches around a doorknob to aid in locating the doorknob in low-light conditions, such as nighttime or during a power outage in an interior room.

2. Related Art.

Locating a doorknob in low or no-light conditions can be a matter of simple convenience or it can be a life saving act. In the event of a fire, electrical power is often lost, thus putting a room into total darkness. If the occupant of the room is not familiar with the room layout and/or door location, such as in a motel room, emergency egress is difficult if not impossible. It would therefore be a new and useful improvement for a visual reference marker to be portable or easily attached to a door to mark the location of the doorknob for means of exit.

Prior art includes the use of a phosphorescent plastic ring to locate a keyhole to a tumbler-type key lock, such as disclosed by Sowers in U.S. Pat. No. 4,914,554. The ring is adhesively attached to the face of the tumbler key lock, to guide the insertion of the key in low-light conditions. However, the ring is designed to be permanently adhered to the lock, and thus can not be used in multiple locations, such as different motel rooms occupied by a traveler. Further, the ring is absent if there is no lock on the door, thus no visual cue guidance is provided directing the occupant to the door or door handle.

Other prior art includes phosphorescent doorknob coverings that attach by hinges or similar means to a predetermined shape doorknob, such as disclosed in the Carr U.S. Pat. No. 4,981,314 and the Randolph U.S. Pat. No. 5,008,551. Neither device works on door handles whose shapes do not conform to the shape of the covering, such as a lever type doorknob. These types of covers are difficult to attach, may slip when trying to turn the doorknob, are not useful in multiple locations, and are limited to specifically shaped doorknobs.

BRIEF SUMMARY OF THE INVENTION

Accordingly, the objectives of this invention are to provide, inter alia, a new and improved door and doorknob locating device and system that:

- is visible in low-light and no-light conditions;
- is economical;
- uses no electricity or other connected power source;
- is easily mounted on a door, or can be hung from a doorknob; and
- can be used without modification on any shaped standard doorknob or door latch opener.

These objectives are addressed by the structure and use of the inventive phosphorescent ring, which is adhesively secured to a door face or suspended on the doorknob shank.

Other objects of the invention will become apparent from time to time throughout the specification hereinafter disclosed.

DETAILED DESCRIPTION OF THE INVENTION

The present invention is illustrated in FIGS. 1–4 and described as system 5, which comprises phosphorescent ring 10. While phosphorescent ring 10 is depicted as generally circular in shape, it is understood that any shape capable of being suspended on doorknob 20 in the preferred embodiment, or any shape capable of being adhered to door face 35 as described below, is understood as being described by this invention.

Phosphorescent ring 10 is typically fabricated of phosphorescent plastic, but may be any material capable of phosphorescence and maintaining a solid or semi-solid shape. In the preferred embodiment, phosphorescent ring 10 is phosphorescent plastic in a generally circular shape, affording ease of hanging on doorknob 20.

OPERATION

Figure 1:
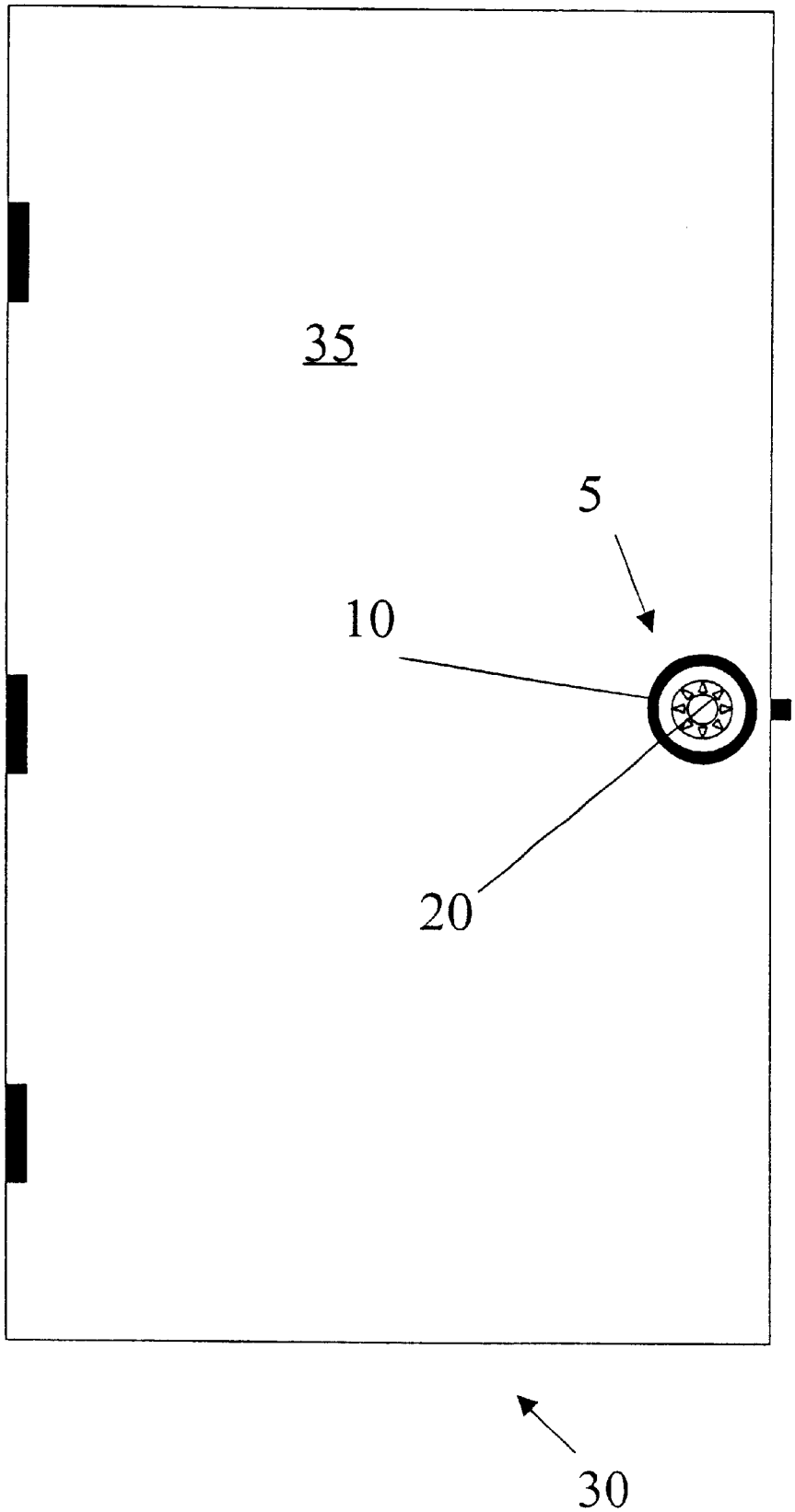
FIG. 1 depicts the inventive ring secured to the face of a door and generally concentric to a doorknob and doorknob shank.
Figure 2:
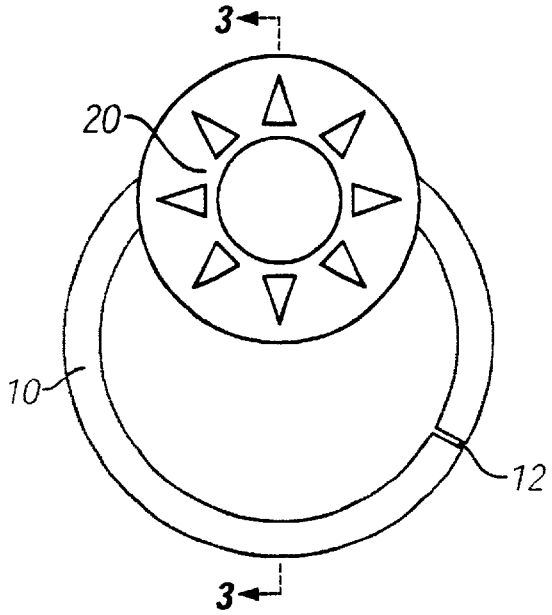
FIG. 2 depicts a close view of the inventive ring hanging unaffixed on a shank of a doorknob.
Figure 3:
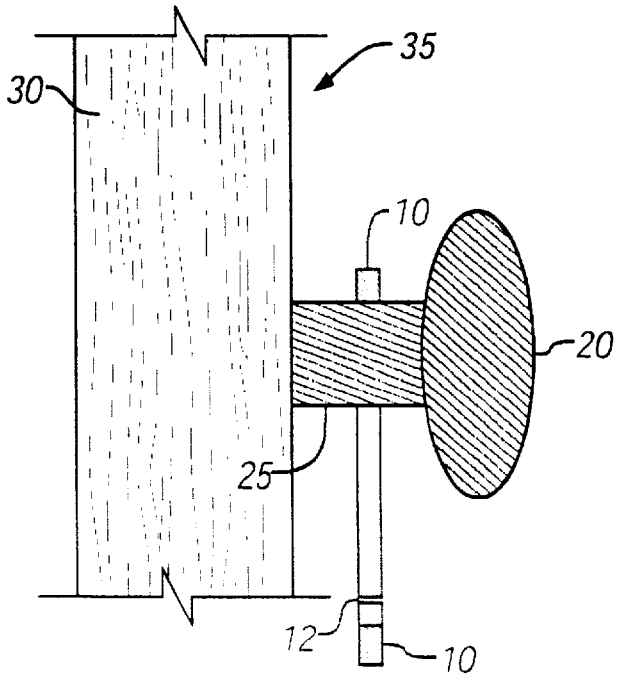
FIG. 3 depicts a cross-sectional view along line 3—3 of FIG. 2 of the inventive ring hanging unaffixed on a shank of the doorknob.

In the first embodiment shown in FIGS. 1–3, phosphorescent ring 10 is adhered to door face 35 using standard plastic/wood adhesive. Phosphorescent ring 10 may have an adhesive backing which presses against door face 35 for securement. The adhesive placement of phosphorescent ring 10 may be on door face 35 or an adjacent structure, such as a doorframe (not shown). The placement is such that door 30 and doorknob 20 are visually marked in a no-light or low-light condition. Phosphorescent ring 10 is preferably adhered to door face 35 as depicted in FIGS. 1–3 generally concentric around doorknob 20 and doorknob shank 25. When positioned generally concentric around doorknob 20 and doorknob shank 25, the occupant of the poorly lit or unlit room is directed to the doorknob by the glow of phosphorescent ring 10. Phosphorescent ring 10 provides both a directional cue and also provides slight illumination of doorknob 20.

Figure 4:
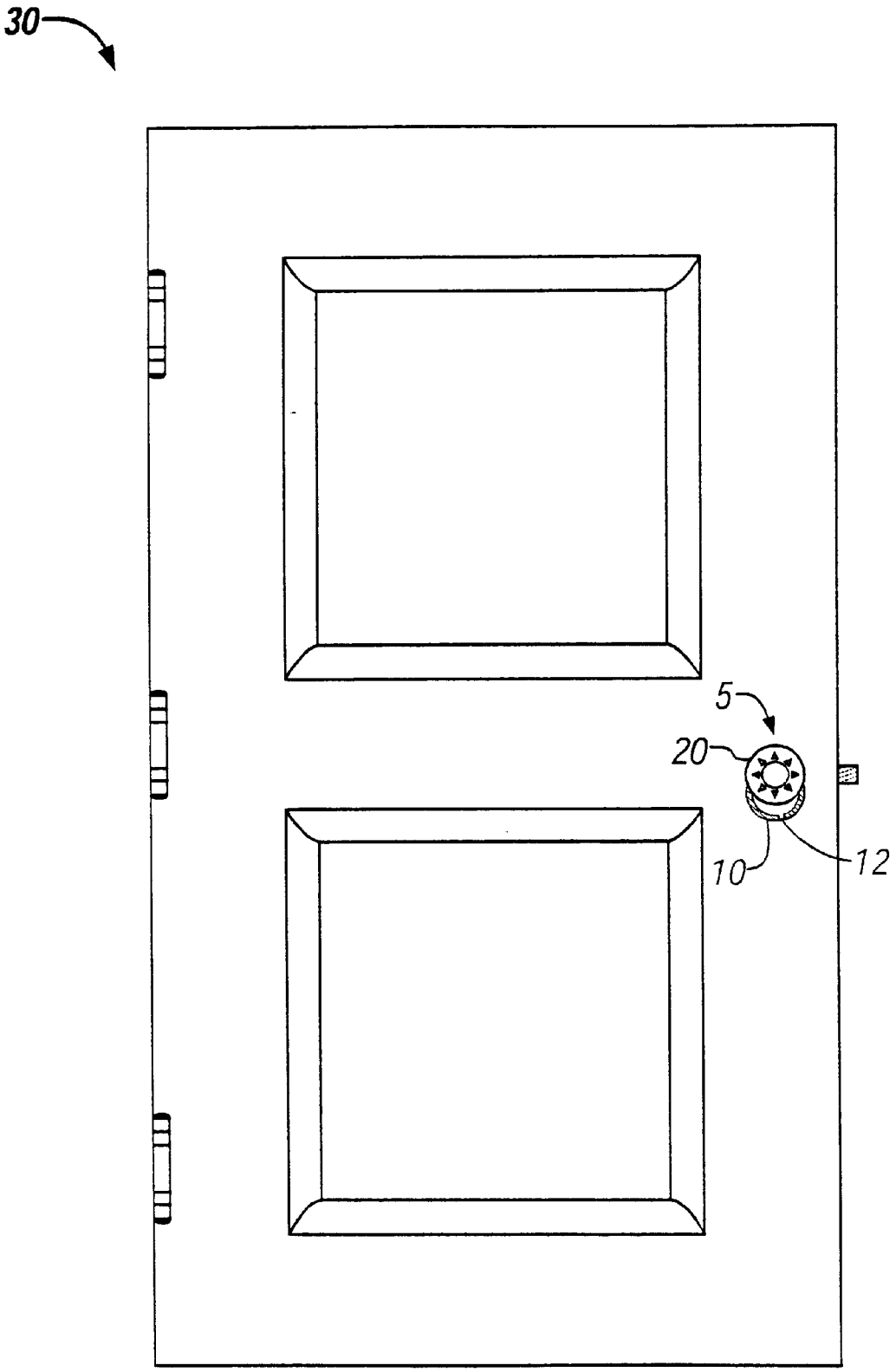
FIG. 4 depicts the preferred embodiment of the phosphorescent ring hanging on a doorknob.

In the preferred embodiment shown in FIG. 4, phosphorescent ring 10 freely hangs around doorknob 20, being suspended on doorknob shank 25. While doorknob 20 is depicted as a circular or flattened spherical shape typical of doorknobs, it is understood that phosphorescent ring 10 is capable of being hung on any doorknob or mechanical door latching device capable of supporting phosphorescent ring 10 by free hanging. Phosphorescent ring 10 may be any shape capable of fitting over doorknob 20, including a triangle, circle, star, square or any other shape.

Phosphorescent ring 10 is a closed shape in the preferred embodiment. In an alternative embodiment, phosphorescent ring 10 is an open shape capable of being hung over the top of doorknob shank 25, such as a horseshoe shape. Doorknob shank 25 is depicted as the connective shaft for doorknob 20, but it is understood that doorknob shank 25 may be any connective shaft for similar functioning mechanical door latching mechanisms. Where phosphorescent ring 10 is an open shape such as a horseshoe, phosphorescent ring 10 is placed over the top of doorknob shank 25 such that the open portion of phosphorescent ring 10 hangs below doorknob shank 25. In another preferred embodiment, phosphorescent ring 10 is a semi-closed shape, with a transverse break 12 in the ring allowing the ring to be deformed open for installation, and then returning to its original closed shape for hanging from doorknob shank 25.

It is understood that phosphorescent ring 10 must be "charged" with natural or artificial light energy to produce a phosphorescent glow. The length, strength and nature of the energy charge of phosphorescent ring 10 are dependent on the material composition of phosphorescent ring 10.

Phosphorescent ring 10 provides a visual due to the location of any doorknob in a dark environment, including exterior doors, passage doors, and similar means of ingress and egress. An anticipated preferred method of use of phosphorescent ring 10 is to afford egress from a room in a dark and unfamiliar room, such as a guestroom or a motel room. The room may be dark because the lights have been turned off by the occupant, who can not later locate the light switches because of confusion or panic in an emergency situation. The room may be dark due to a power outage, including that caused by a fire in the building.

When the occupant of the darkened room needs to exit the room, the charged phosphorescent ring 10 provides a visual cue to locate doorknob 20. The phosphorescent glow and physical shape provide a visual reference for the occupant, who reaches for phosphorescent ring 10, and thereby touches doorknob 20 for exit.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A door locating device comprising:

a phosphorescent ring;

said phosphorescent ring hangable unaffixed on a shank of a mechanical door latching device to provide a visual cue directing a person to a location of said mechanical door latching device in a dark environment;

a transverse break in said phosphorescent ring;

a first ring end and a second ring end at said transverse break;

said phosphorescent ring deformable; whereby said phosphorescent ring may be deformed to provide a separation between said first ring end and said second ring end for installation on said mechanical door latching device; and said phosphorescent ring returnable to its original shape upon said hanging.

2. A door locating device as in claim 1, wherein said mechanical door latching device is a doorknob.

3. A method of locating a door in a darkened environment, comprising:

hanging a phosphorescent ring on a shank of a mechanical door latching device, whereby an occupant of said darkened environment is guided to said mechanical door latching device by visual cues provided by said phosphorescent ring, affording said occupant egress from said darkened environment, wherein said phosphorescent ring includes a transverse break, such that said phosphorescent ring can be mechanically deformed to an open shape to aid in said hanging, and said phosphorescent ring returning to its original shape upon said hanging.

4. A method as in claim 3, wherein said mechanical door latching device is a doorknob.

* * * * *